US009168673B2

(12) United States Patent
Coggin

(10) Patent No.: US 9,168,673 B2
(45) Date of Patent: Oct. 27, 2015

(54) DEVICE FOR REMOVING DEBRIS FROM PASSAGES IN MANUFACTURED MODULAR BLOCKS

(71) Applicant: Michael Coggin, Telford, PA (US)

(72) Inventor: Michael Coggin, Telford, PA (US)

( * ) Notice: Subject to any disclaimer, the term of this patent is extended or adjusted under 35 U.S.C. 154(b) by 118 days.

(21) Appl. No.: 14/198,025

(22) Filed: Mar. 5, 2014

(65) Prior Publication Data

US 2015/0251334 A1 Sep. 10, 2015

(51) Int. Cl.
*A47L 5/38* (2006.01)
*B28B 11/22* (2006.01)

(52) U.S. Cl.
CPC ... *B28B 11/22* (2013.01); *A47L 5/38* (2013.01)

(58) Field of Classification Search
CPC ..... B28B 11/22; A47L 5/38
USPC ..... 15/304, 306.1, 312.1; 425/225, 229, 425/232
See application file for complete search history.

(56) References Cited

U.S. PATENT DOCUMENTS

| | | | | |
|---|---|---|---|---|
| 2,916,793 | A | | 5/1954 | Ellis et al. |
| 3,131,947 | A | | 5/1964 | McCarty et al. |
| 3,339,435 | A | | 9/1967 | Heitz |
| 3,583,821 | A | | 6/1971 | Shaub |
| 3,679,340 | A | | 7/1972 | Springs |
| 3,788,017 | A | | 1/1974 | Bachus |
| 4,036,570 | A | | 7/1977 | Cruzen et al. |
| 4,047,690 | A | | 9/1977 | Winter et al. |
| 4,095,925 | A | | 6/1978 | Cruzen et al. |
| 4,242,299 | A | * | 12/1980 | Adams ..... 264/504 |
| 4,896,472 | A | | 1/1990 | Hunt |
| 4,914,876 | A | | 4/1990 | Forsberg |
| 4,955,984 | A | | 9/1990 | Cuevas |
| 5,061,123 | A | | 10/1991 | Broussard |
| 5,160,230 | A | | 11/1992 | Cuevas |
| 5,653,561 | A | | 8/1997 | May |
| 5,827,015 | A | | 10/1998 | Woolford et al. |
| 5,942,181 | A | | 8/1999 | Rondeau |
| 6,176,049 | B1 | | 1/2001 | Crant et al. |
| 6,257,865 | B1 | | 7/2001 | Rondeau |
| 6,425,751 | B1 | | 7/2002 | Bergeron et al. |
| 6,488,491 | B1 | | 12/2002 | Nelson et al. |
| 6,530,769 | B1 | | 3/2003 | Rondeau et al. |
| 6,604,930 | B1 | | 8/2003 | Lumsden et al. |
| 6,655,107 | B2 | | 12/2003 | Dean |
| 6,764,294 | B2 | | 7/2004 | Saddler |
| 6,814,527 | B1 | | 11/2004 | Fleming |
| 6,814,906 | B2 | | 11/2004 | Bergeron et al. |
| 7,500,845 | B2 | | 3/2009 | Ness |
| 7,730,685 | B1 | | 6/2010 | Keene |
| 7,958,587 | B1 | | 6/2011 | Hansen |

(Continued)

*Primary Examiner* — David Redding
(74) *Attorney, Agent, or Firm* — Caesar Rivise, PC

(57) ABSTRACT

A device for removing concrete debris from passages within modular blocks is disclosed. The device includes nozzles mounted to a plate at locations corresponding to the passages on the modular blocks. An actuator is secured to the block molding machine, supports the plate, and moves the plate from a retracted position to an extended position in close proximity to the conveyor. The nozzles are operatively connected to a source of compressed air and are arranged to enter within the passages of the modular block when the plate moves to the extended position. A control system directs operation of the device such that when a modular block reaches a predetermined location on the conveyor, the actuator moves the mounting plate to the extended position causing the nozzles to enter within the passages of the modular block and emit jets of compressed air to remove concrete debris from within the passages.

6 Claims, 10 Drawing Sheets

(56) References Cited

U.S. PATENT DOCUMENTS

| | | | |
|---|---|---|---|
| 7,972,128 | B2 | 7/2011 | Mugge et al. |
| 8,133,337 | B2 | 3/2012 | Dardanis et al. |
| 8,381,841 | B2 | 2/2013 | Caneer |
| 8,524,138 | B2 | 9/2013 | Johnson |
| 2001/0007380 | A1 | 7/2001 | LaCroix et al. |
| 2002/0104687 | A1 | 8/2002 | Bongers-Ambrosius |
| 2003/0167728 | A1 | 9/2003 | Mohlenhoff |
| 2004/0004310 | A1 | 1/2004 | LaCroix et al. |
| 2004/0104511 | A1 | 6/2004 | Griffith |
| 2006/0117697 | A1 | 6/2006 | Adam |
| 2007/0028548 | A1 | 2/2007 | Johnson et al. |
| 2007/0243031 | A1 | 10/2007 | Yun |
| 2008/0184650 | A1 | 8/2008 | Fischer |
| 2009/0000234 | A1 | 1/2009 | Bott et al. |
| 2011/0179747 | A1 | 7/2011 | Macdonald et al. |
| 2011/0278907 | A1 | 11/2011 | Moller |

* cited by examiner

FIG. 5
(Prior Art)
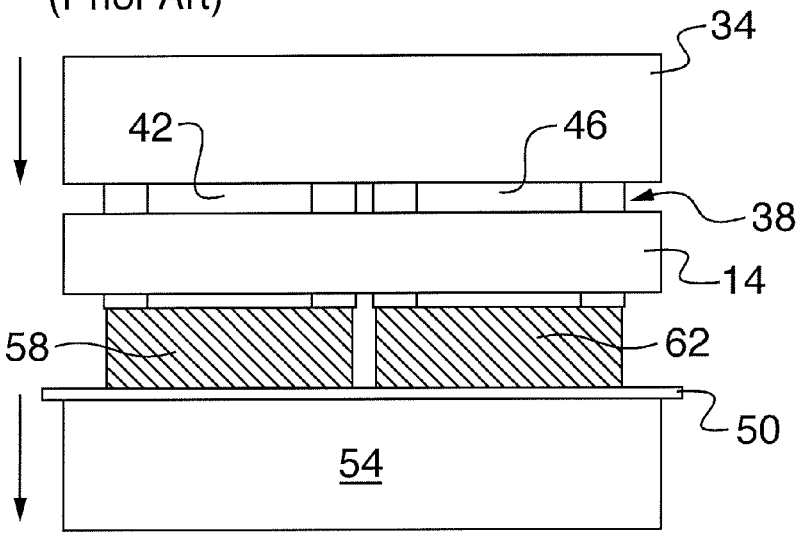
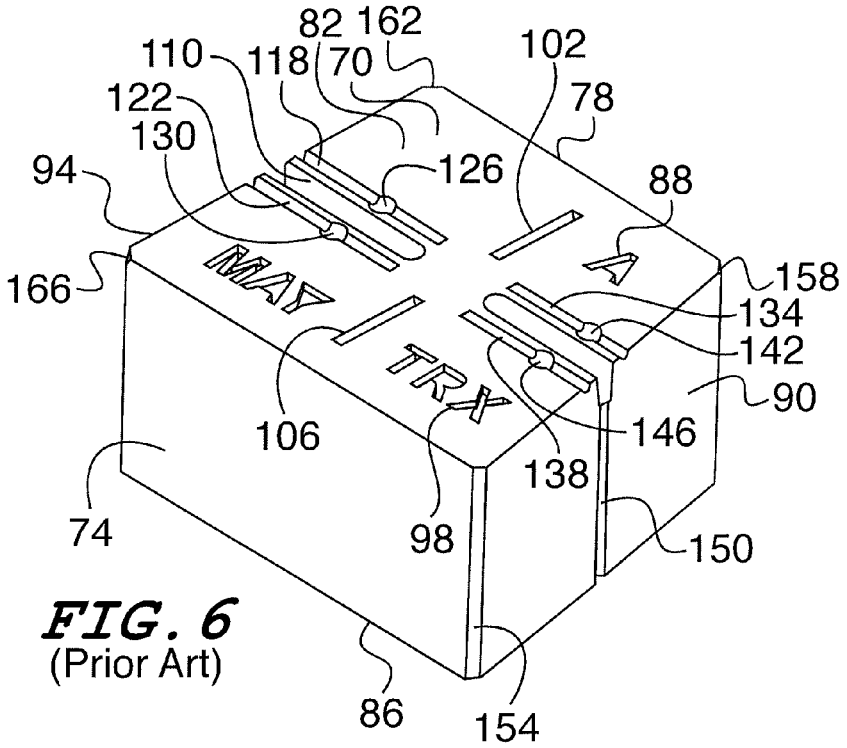
FIG. 6
(Prior Art)

DEVICE FOR REMOVING DEBRIS FROM PASSAGES IN MANUFACTURED MODULAR BLOCKS

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to the manufacture of concrete blocks. More specifically, this invention relates to a device for removing debris from passages in manufactured modular blocks, such as wallstones.

BACKGROUND OF THE INVENTION

Modern, high speed, automated concrete block plants and concrete paver plants make use of concrete block molds that are open at the top and bottom. These molds are mounted in machines which cyclically station a pallet below the mold to close the bottom of the mold, deliver dry cast concrete into the mold through the open top of the mold, densify and compact the concrete by a combination of vibration and pressure, and strip the uncured blocks from the mold by a relative vertical movement of the mold and the pallet. Once the blocks are stripped from the mold they are protected until they are sufficiently hardened to permit handling without damage. The concrete blocks thus hardened are cured in a curing yard to permit complete moisturization for at least twenty-one days.

For efficient high-volume production, concrete block molds are typically configured to produce multiple blocks simultaneously. A concrete block mold generally comprises side walls and end walls that define the periphery of a mold cavity. Within this mold cavity, division plates may be used to sub-divide the mold cavity into a plurality of block-forming cavities. Further, movable side walls may be used to form the side faces of the block-forming cavity. The division plates are generally rectangular-shaped plates attached to the side walls of the mold. Further, the side walls of the block cavity and the division plates may be covered with replaceable mold face linings to protect the mold components from abrasive wear.

Concrete blocks fabricated by the automated processes described above are often used in the construction of vertical walls, such as sitting walls, or set-back retaining walls for securing earth embankments against sliding and slumping. The blocks, often referred to as wallstones are stacked on each other and located in rows to form a wall. The wall structure can have a variety of shapes, such as linear, concave, and convex curved, serpentine and circular to conform to the landscape utilization. Each wallstone may have one or more attractive and decorative faces. The decorative faces can be smooth, serrated, horizontally grooved, vertically grooved, diagonally grooved, checkerboard or have an aggregate appearance. The front face of the block can be broken apart concrete or broken irregular pattern. The wallstone may be of any desired color including gray or earth tones and the like.

Each wallstone may have a generally flat top and bottom surface so that the rows of wallstones can be stacked or superimposed on top of each other. The adjacent rows of blocks may be connected together with rods or pins. Each block has one or more passages extending from the top surface to the bottom surface to accommodate the rods or pins. Rows of wallstones overlap each other so that each wallstone is pinned to adjacent wallstones located in adjacent courses of wallstone above and below. Multiple passages may be provided to the wallstones to add versatility so that each wallstone may be used in the construction of a vertical wall or a set-back wall.

For example, the wallstone may be fabricated to be versatile by providing six passages, four to be utilized for the construction of a set-back wall and two to be utilized for the construction of a vertical wall. To construct a set-back wall, after a first layer of wallstone is set and leveled in all directions to create a base, a subsequent course is added such that the two front passages of the subsequent layer wallstones are aligned above a pocket (also referred to as an "offset pocket") located in the wallstones in the course below, to create a slight offset. After the wallstones are set and visually aligned, pins are dropped in these two holes and into the pockets in the wallstones of the base layer. This process is repeated as subsequent courses are added above previous courses to construct a set-back wall. In this manner, the wallstones become interlocked together, adding strength and integrity to the overall wall structure. To construct a vertical wall, the two passages located in the pocket of the wallstones of the subsequent course are aligned above the pocket of the wallstones in the previous course, and pins are dropped in these two holes and into the pocket in the wallstones of the previous course.

A common drawback is that during fabrication of the wallstones, debris created during the fabrication process can become lodged in the passages. If not removed quickly, the debris will cure within the passages and create obstructions therein, thus preventing use of the interlocking feature of the wallstones. Currently, the method for cleaning the passages of such debris involves manually inserting a dowel into each of these passages after the wallstone is stripped from the mold within the production environment and which adds to the overall cost and increases safety concerns. Such manual debris removal from the passages has other disadvantages. It is a delicate operation requiring a certain amount of dexterity to avoid damaging the passages of uncured wallstones. Also, the current manual cleaning requires added labor expressly dedicated to this particular task to keep pace with the high volume of wallstone being produced by the automated process. Thus, the debris removal device of the present invention offers significant advantages over the current manual cleaning described above. The debris removal device of the present invention is operative to direct a flow of pressurized fluid, such as air through a plurality of outlets and through the passages of wallstones as the wall stones are conveyed after being stripped from the mold. The device of the present invention is automated and may be integrated into the concrete block manufacturing process, thus eliminating the need for increased labor. Also, the device of the present invention can remove debris from multiple passages simultaneously to keep pace with the rate of automated production. Also, the device will substantially reduce the potential for damage to the wallstone passages.

SUMMARY OF THE INVENTION

A device for removing concrete debris from passages within modular blocks is disclosed. The device includes nozzles mounted to a plate at locations corresponding to the passages on the modular blocks. An actuator is secured to the block molding machine, supports the plate, and moves the plate from a retracted position to an extended position in close proximity to the conveyor. The nozzles are operatively connected to a source of compressed air and are arranged to enter within the passages of the modular block when the plate moves to the extended position. A control system directs operation of the device such that when a modular block reaches a predetermined location on the conveyor, the actuator moves the mounting plate to the extended position causing the nozzles to enter within the passages of the modular block and emit jets of compressed air to remove concrete debris from within the passages.

DESCRIPTION OF THE DRAWINGS

FIG. 5 is a prior art concrete molding machine illustrating the compressed concrete block being ejected by the head shoe assembly moving downward as the movable plate that forms the bottom of the mold moves downward;

FIG. 6 is a perspective view of a first concrete block such as a wallstone of a prior art modular block system;

DETAILED DESCRIPTION OF THE PREFERRED EMBODIMENT

Figure 1:
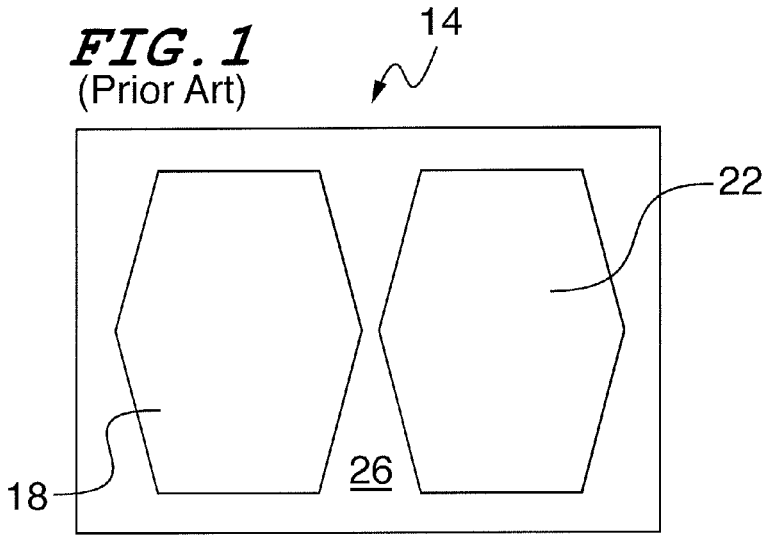
FIG. 1 (Prior Art)
FIG. 1 is a top view of an exemplary prior art mold for forming concrete blocks.
Figure 2:
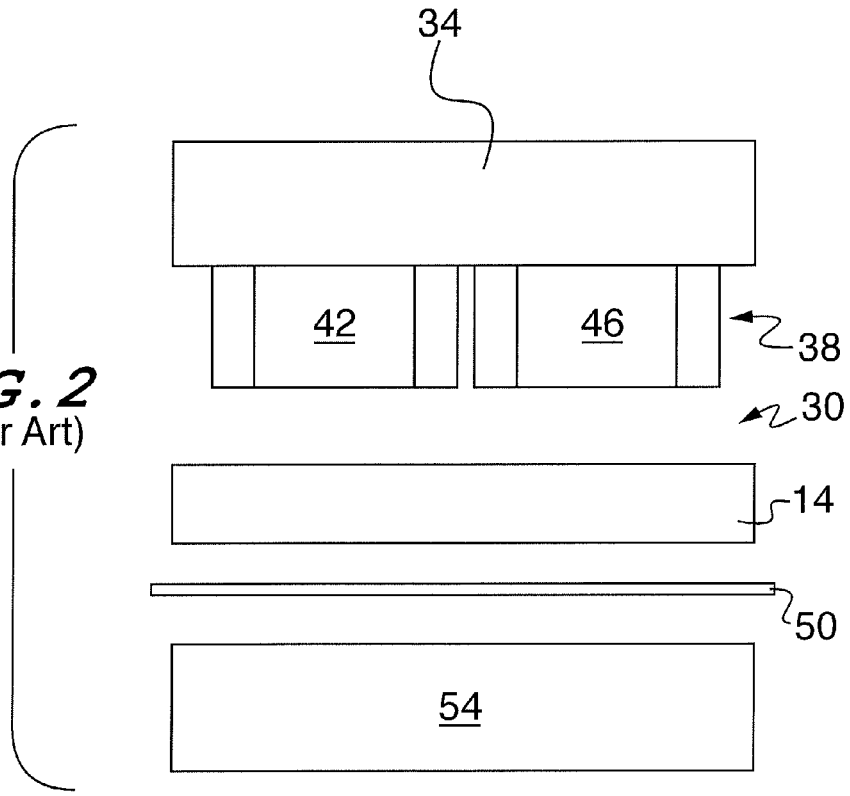
FIG. 2 (Prior Art)
FIG. 2 is a side view showing the arrangement of the prior art mold in FIG. 1 in a prior art concrete block molding machine.

Referring now in greater detail to the drawings in which like numerals represent like components throughout the several views, the process for molding a concrete block such as a wallstone is described. Referring to FIG. 1, there is shown an end view of a prior art mold assembly 14 for molding a concrete block, such as a wallstone is shown. The prior art mold assembly 14 may include two openings 18 and 22 that are surrounded by side walls 26. Note that openings 18 and 22 preferably extend the full depth of the mold assembly 14. FIG. 2 shows a side view showing various components in a prior art concrete block molding machine 30. The prior art mold assembly 14 is arranged to be bolted to the concrete block molding machine 30. Examples of concrete block molding machines for which the prior art mold assembly 14 include models manufactured by Columbia and Besser. In one embodiment, installation of the mold assembly 14 in the concrete block molding machine 30 further includes installation of a core bar assembly, which is known to those skilled in the art, which is positioned within the mold cavity to create through holes or passages within the formed block in accordance with design requirements of a particular block. The prior art mold assembly 14 is fixedly attached to the concrete block molding machine 30 so its position does not change with respect to the molding machine 30. A top plunger 34 includes a head shoe assembly 38 that has two protruding portions 42 and 46 that have shapes corresponding to the openings 18 and 22 in the mold 14, and are just slightly smaller to allow the protruding portions 42 and 46 of the shoe assembly to pass through the full depth of the mold 14 within the openings 18 and 22. A movable plate 50 known in the art as a "pallet" forms the bottom of the mold 14, and is raised and lowed by a bottom plunger 54. The top plunger 34 and bottom plunger 54 are moved up and down with respect to mold 14 to form a manufactured wallstone, as discussed in more detail below.

Figure 3:
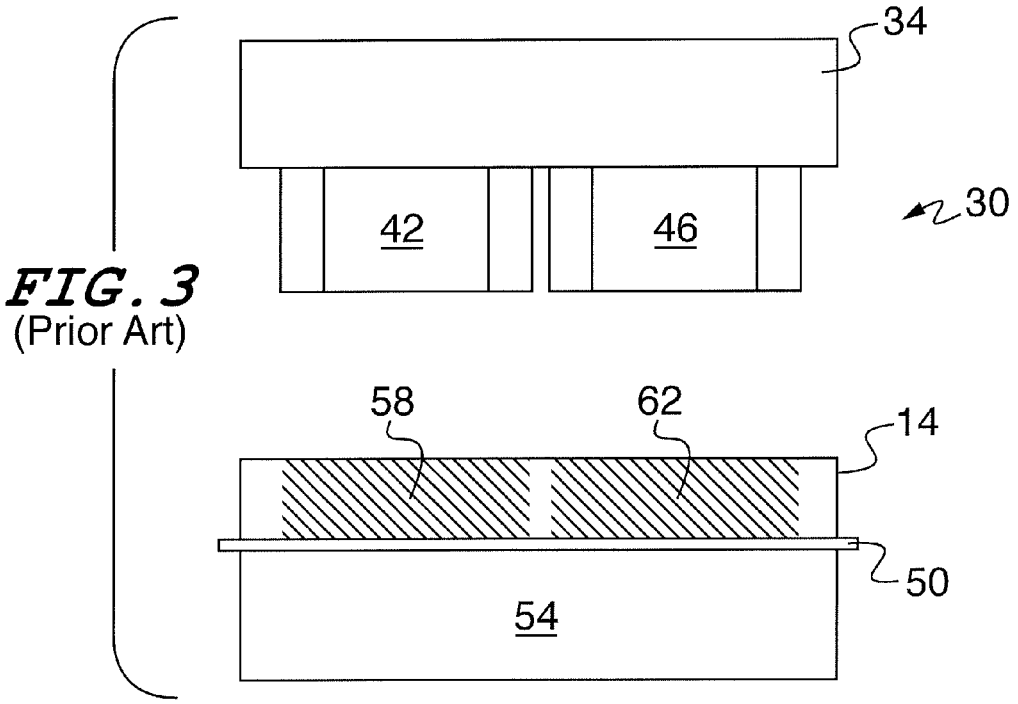
FIG. 3 (Prior Art)
FIG. 3 is a prior art concrete molding machine showing the mold after being filled with a known concrete block mix.
Figure 4:
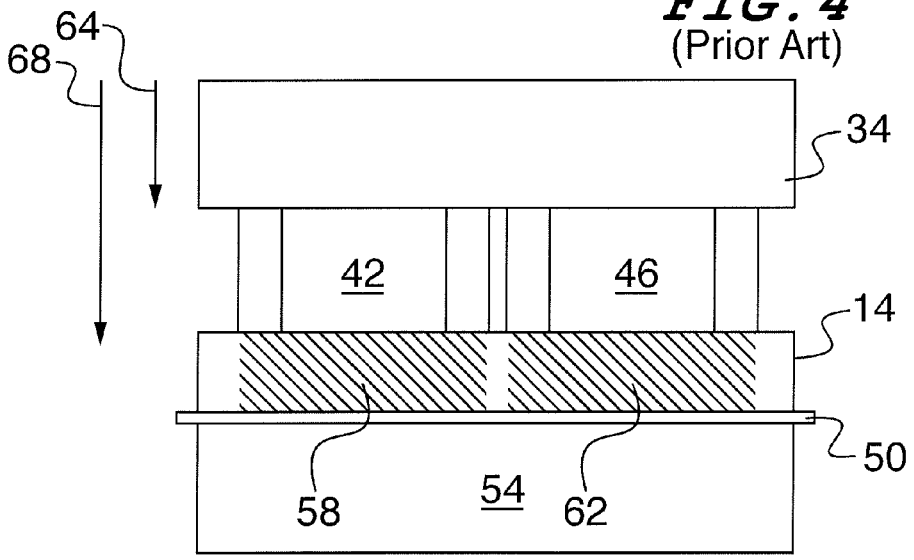
FIG. 4 (Prior Art)
FIG. 4 is a prior art concrete molding machine illustrating the head shoe assembly compressing the concrete mix in the mold.

FIG. 3 shows the concrete block molding machine 30 after the block mix has been poured into the mold 14, as shown by the hatched portions 58 and 62 in the mold 14. The movable plate 50 is moved by bottom plunger 54 to contact the bottom of the mold 14. The block mix is then poured into the mold 14, then screeded off even with the top of the mold 14. Many concrete block molding machines have top hoppers that receive block mix from a belt-type conveyor, and have feed drawers that direct the block mix from the top hopper into the mold, then screed off the excess block mix to be even with the top of the mold. This process is well-known, and is therefore not discussed here in further detail. Once the block mix is in the mold, the top plunger 34 moves down the protruding portions 42 and 46 of the head shoe assembly 38 to contact the top of the block mix at 58 and 62, as shown by the smaller arrow 64 in FIG. 4. Once contact is made, substantial pressure is applied to the block mix at 58 and 62 by the protruding portions 42 and 46 of the head shoe assembly 38 to compact or compress the block mix, as represented by the larger arrow 68 in FIG. 4. The compaction of the block mix under high compressive force evenly distributes the block mix in the mold, and also hardens the block mix so the block will retain its shape after being ejected from the mold after only a few seconds of compression in the mold. As shown in FIG. 5, after the block mix has been sufficiently compressed for a sufficient period of time, the top plunger 34 pushes the head shoe assembly 38 down at the same time the bottom plunger 54 is moving the movable plate 50 down, resulting in the blocks 58 and 62 being ejected from the mold 14. At this point the top plunger 34 may move up to its original position shown in FIG. 3, the movable plate 50 with the blocks 58 and 62 is typically conveyed away from the concrete block molding machine 30, and a new movable plate will be placed on the bottom plunger 34, which will then move the movable plate to contact the bottom surface of the mold as shown in FIG. 3. At this point the cycle can repeat, forming and ejecting a block in a matter of seconds. A typical cycle time for a concrete block molding machine is 12-15 seconds, but may be significantly faster or slower depending on the features and age of the concrete block molding machine.

An example of a block made from the molding process described above is indicated at 70 in FIG. 6. The block 70, shown in perspective view in FIG. 6, is a retaining wall block that uses a pin and groove design to assist in stabilizing a wall. The block 70 has the front face 74, a back face 78, a top 82, a bottom 86, a first side 90, and a second side 94. The faces 74 and 78, the top 82, the bottom 86, and the sides 90 and 94 are used to form the block 70. The block 70 may be a first block utilized in a modular block system which may be comprised of several differently shaped blocks, e.g., four differently shaped blocks. The top 82 has formed therein an indicator 88 to indicate which block in the modular block system this particular block is. In this case, the block 70 is referenced as being the "A" block in the modular block system. Other blocks (not shown) in the modular block system may include indicators such as "B", "Y" or "X". As can be appreciated, when constructing a structure using the modular block system, instructions may be included with the system to show where to place this particular block 70. Also formed in the top 82 of the block 70 is a marking 98 that shows the name of the modular block system.

Figure 7:
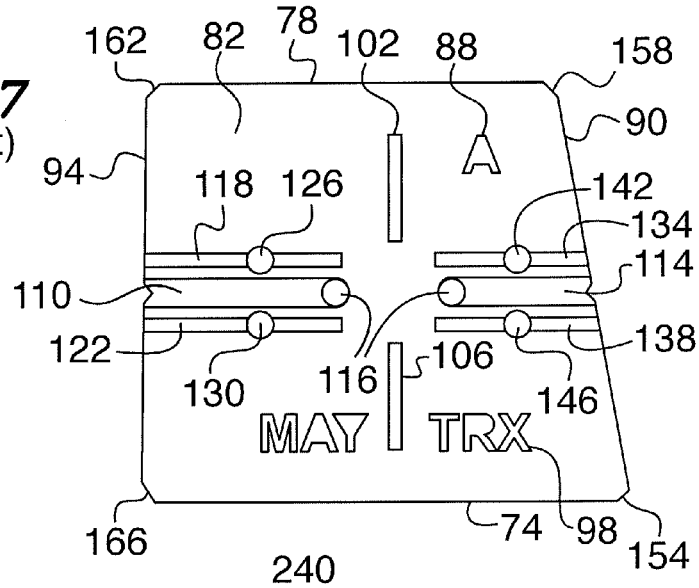
FIG. 7 (Prior Art)
FIG. 7 is a top view of the first concrete block or wallstone shown in FIG. 6.

The top 82 has a pair of score lines or recesses 102 and 106 that are used to split the block 70 into two separate blocks. The score lines 102 and 106 allow the block 70 to be split into two blocks with the score lines 102 and 106 being centered on the wider or front face 74. The top 82 also has a pair of offset pockets 110 and 114 formed therein. The offset pockets 110 and 114 are used to construct a retaining wall structure in a tiered formation with each tier being setback or offset from each other. The pockets 110 and 114 provide for a predetermined or preselected distance that each of the tiers will be setback. As best shown in FIG. 7, within each pocket 110 and 114 is a passage 116 that may extend the entire height of the block 70. On each side of the pocket 110 is a pair of shallow grooves 118 and 122. Within the groove 118 is a passage 126 and within the groove 122 is a passage 130. The passages 126 and 130 may extend the entire height of the block 70. The passages 116, 126 and 130 are adapted to receive rods or pins for use in constructing a landscaping structure. Further, on each side of the pocket 114 is another pair of grooves 134 and 138. Again, within the groove 134 is a passage 142 and within the groove 138 is a passage 146. The passages 142 and 146 may extend the entire height of the block 70. The block 70 also may have an alignment groove 150 along the first side 90 centered on the pocket 114. Although not shown, there is an alignment groove on the second side 94 centered with the pocket 110. The alignment groove 150 is used to align or offset the blocks of the modular block system 10 when constructing a wall structure.

With reference now to FIG. 7, a top view of the block 70 is illustrated. The block 70 is shown to have the front face 74 being wider or longer than the back face 78. This is due to the first side 90 being slanted back toward the back face 78. Also, the second side 94 is not slanted at all, but is straight from the front face 74 to the back face 78. The block 70 also has beveled corners 154, 158, 162 and 166. The reason the corners 154, 158, 162 and 166 are beveled is to prevent the block 70 from being broken or chipped during manufacturing, transportation, storage, or handling. Although not shown in this particular illustration, the back face 78 also has a split face surface. The block 70 is also depicted having the indicator 88 and the marking 98 formed in the top 82. The score lines 102 and 106 are parallel to the second side 94. The score lines 102 and 106 only span a portion of the top 82. Other blocks similar in design that are included in the modular block system are described more fully in U.S. Pat. No. 8,176,702, entitled "Modular Block System" the relevant portions of which are hereby incorporated by reference.

Figure 8:
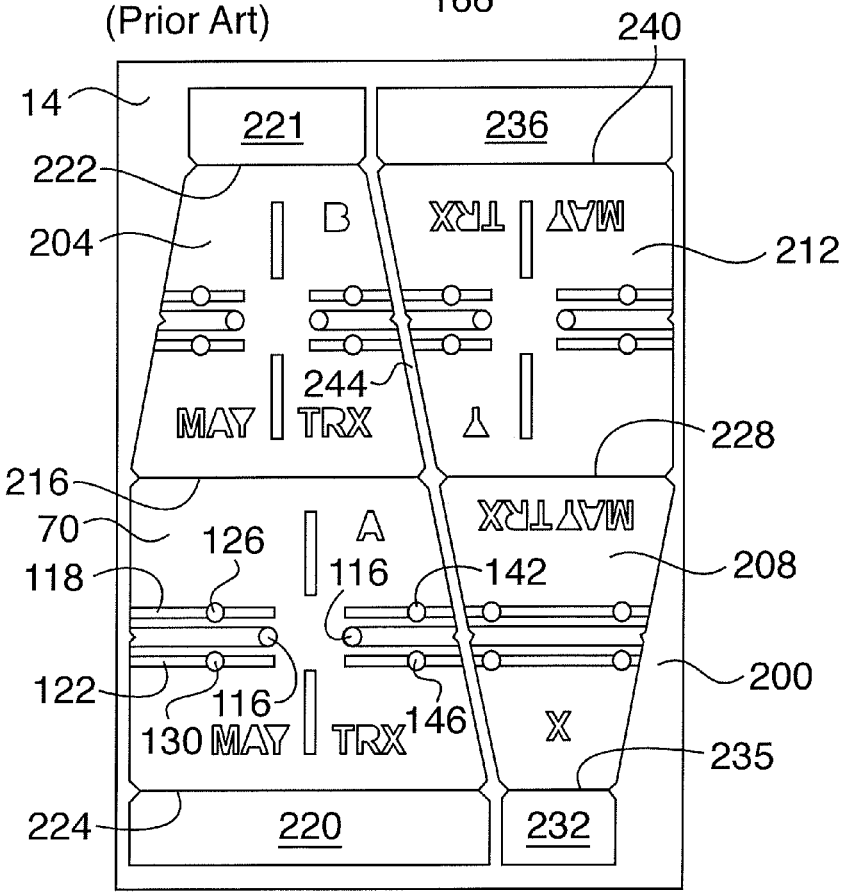
FIG. 8 (Prior Art)
FIG. 8 is a top view of a mold box having a first, second, third, and fourth blocks and pavers formed therein.

FIG. 8 shows a mold box 200 for forming the modular block system comprising the first block 70, a second block 204, a third block 208 and a fourth block 212 formed therein. The mold box 200 is generally rectangular in shape and may have dimension of 26 inches by 18½ inches. The first block 70 and the second block 204 are formed together at a junction or score line 216. The blocks 70 and 204 may be split apart from each other. Also, the first block 70 may have the back face 78 formed by splitting a paver 220 at a junction or score line 224. Splitting a paver 220 at a score line 224 forms the back face 78 of the first block 70. Similarly, splitting a paver 221 at a score line 222 forms the back face of the second block 204. The third block 208 and the fourth block 212 are initially formed together at a score line 228. Once the third block 208 and the fourth block 212 are separated along the score line 228, split faces are formed. The back face of the third block 208 is formed by splitting a paver 232 along a score line 235. Finally, the fourth block 212 is completed by splitting a paver 236 along a score line 240. The pavers 220, 221, 232, and 236 may be used for other landscaping projects and do not need to be discarded. The first and second blocks 70, 204 are not connected to the third and fourth blocks, 208 and 212 during the manufacturing process, as there is a gap 244 therebetween.

As can be appreciated, the blocks 70, 204, 208 and 212 along with the pavers 220, 221, 232 and 236 of the present invention are formed in the mold box 200. Generally, the process entails molding the blocks 70, 204, 208 and 212 and the pavers 220, 221, 232 and 236 by using a mixture of cement and water and other materials, as described above. The blocks 70, 204, 208 and 212 and the pavers 220, 221, 232 and 236 are fabricated by compressing and vibrating the mixture in the mold box 200 by the application of pressure to the mixture by use of a block molding machine as described above. It is also known to use a press head having a press plate for applying pressure to the mold box 200. Further, the press plate may include structure that forms the shallow grooves, the indicators, and the markings in each of the blocks 70, 204, 208 and 212. Also, an insert bar may be used to form the passages 116, 126, 130, 142, and 146 and the offset pockets 110 and 114 in each of the blocks 70, 204, 208 and 212. Once the blocks and pavers are formed they may be cured through any method known in the art. For example, curing may take the form of air curing for a number of days or steam curing, but normally one day is allowed or needed for cure.

Figures 9, 10A:
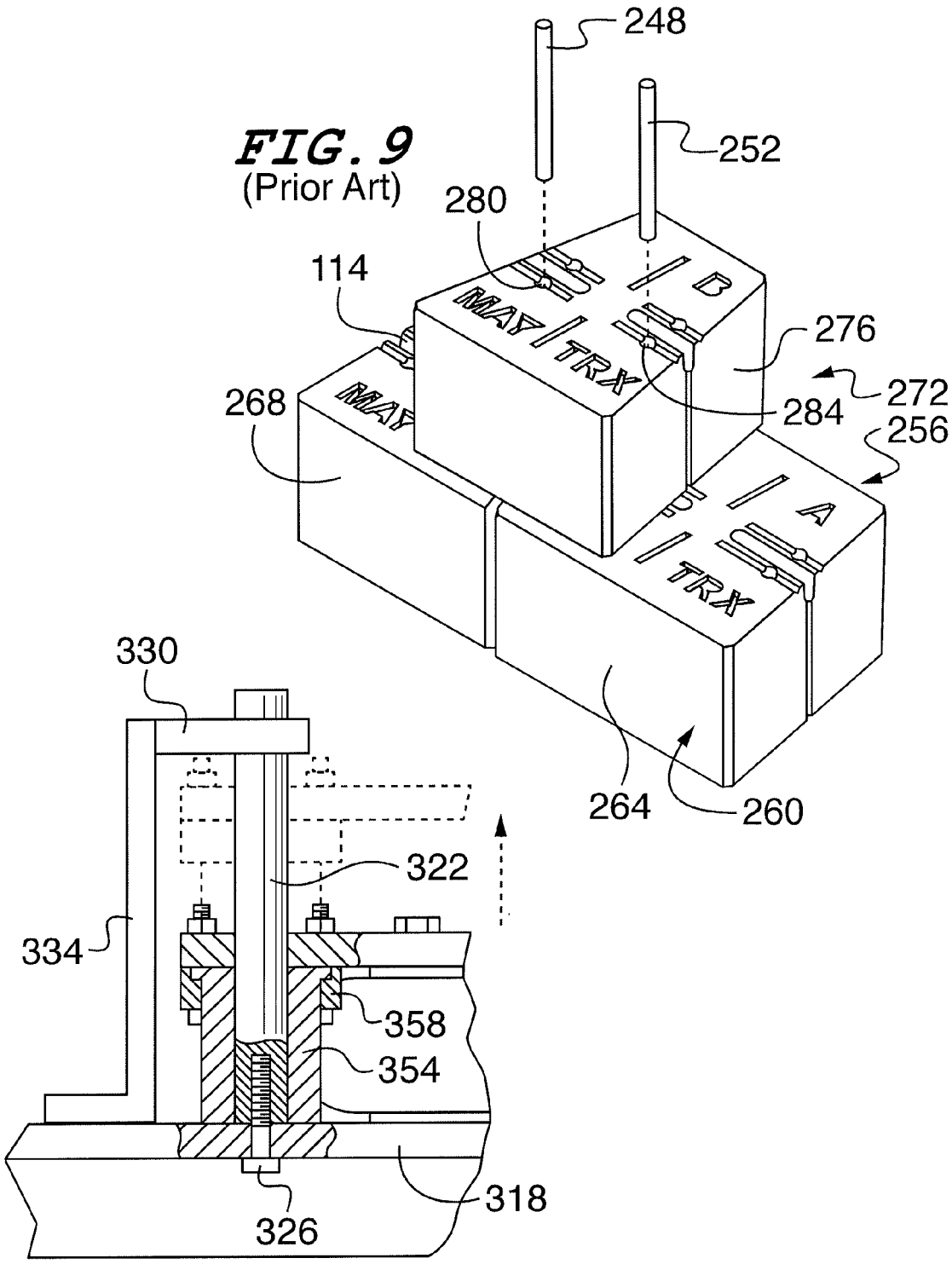
FIG. 9 (Prior Art)
FIG. 9 is a perspective view of a structure constructed with the prior art modular wallstones of FIG. 8.
FIG. 10A is a detail view of an encircled portion of FIG. 10 illustrating movement of the device of the present invention between a retracted position and an extended position.

FIG. 9 depicts how rods or pins 248 and 252 may be used with the modular block system. A structure 256 is constructed by forming a first course 260 that consists of an "A" block 264 and a "Y" block 268. A second course 272 that includes a "B" block 276 is placed over the first course 260. The pin 248 is inserted into the passage 280 to pass through the block 276 to be captured in the offset pocket 114 of the block 268. In particular, if the pin 248 is six and a half inches long and the block 276 is six inches thick then about a half inch of the pin 248 will be lodged or captured in the pocket 114. The pin 252 is inserted into the passage 284 to pass through the block 276 into the offset pocket (not shown) of the block 264. The pocket is not visible or shown due to the block 276 covering the pocket. By using the pins 248 and 252 and the passages 280 and 284 and the offset pockets, the block 276 of the second course 272 is offset or setback a distance from the first course 260. An example of the setback may be three quarters of an inch.

As discussed previously, debris created during the fabrication process can become lodged in the passages 116, 126, 130, 142 and 146. It is not uncommon for debris to accumulate within these passages to a depth of two inches or greater. If not removed quickly, the debris will cure within the passages and create obstructions therein, thus preventing use of the pins 248 and 252 for creating an offset or setback of courses of the wallstones. Under the present invention, a device is provided for injecting air within the passages so that loose concrete particles within the passages can be flushed out so the passages are useable for the purposes mentioned above.

Figure 10:
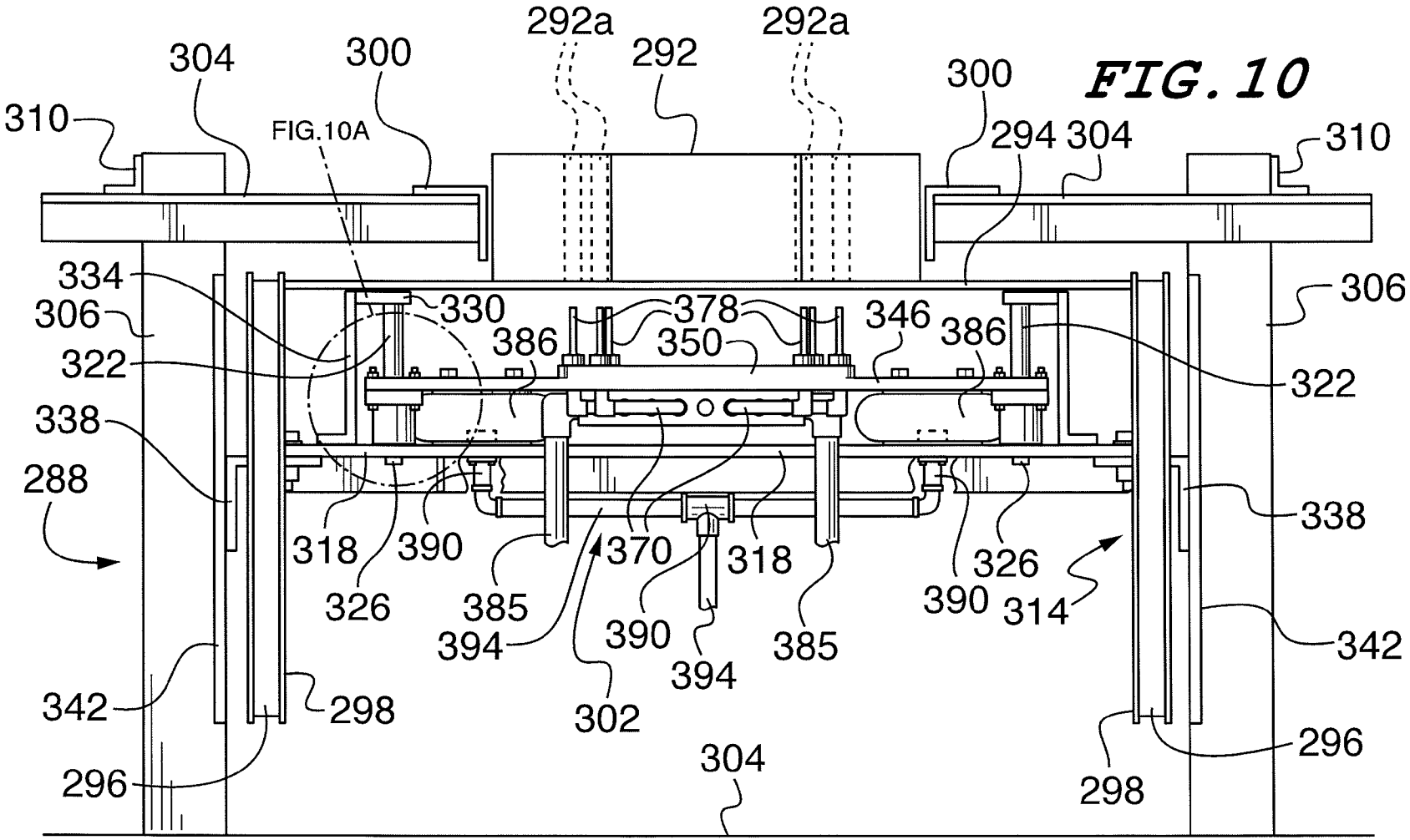
FIG. 10 is an elevational view of the device for removing debris from passages of concrete modular blocks of the present invention shown attached to the framework of a concrete block molding machine, illustrating the device in the retracted position.
Figure 12:
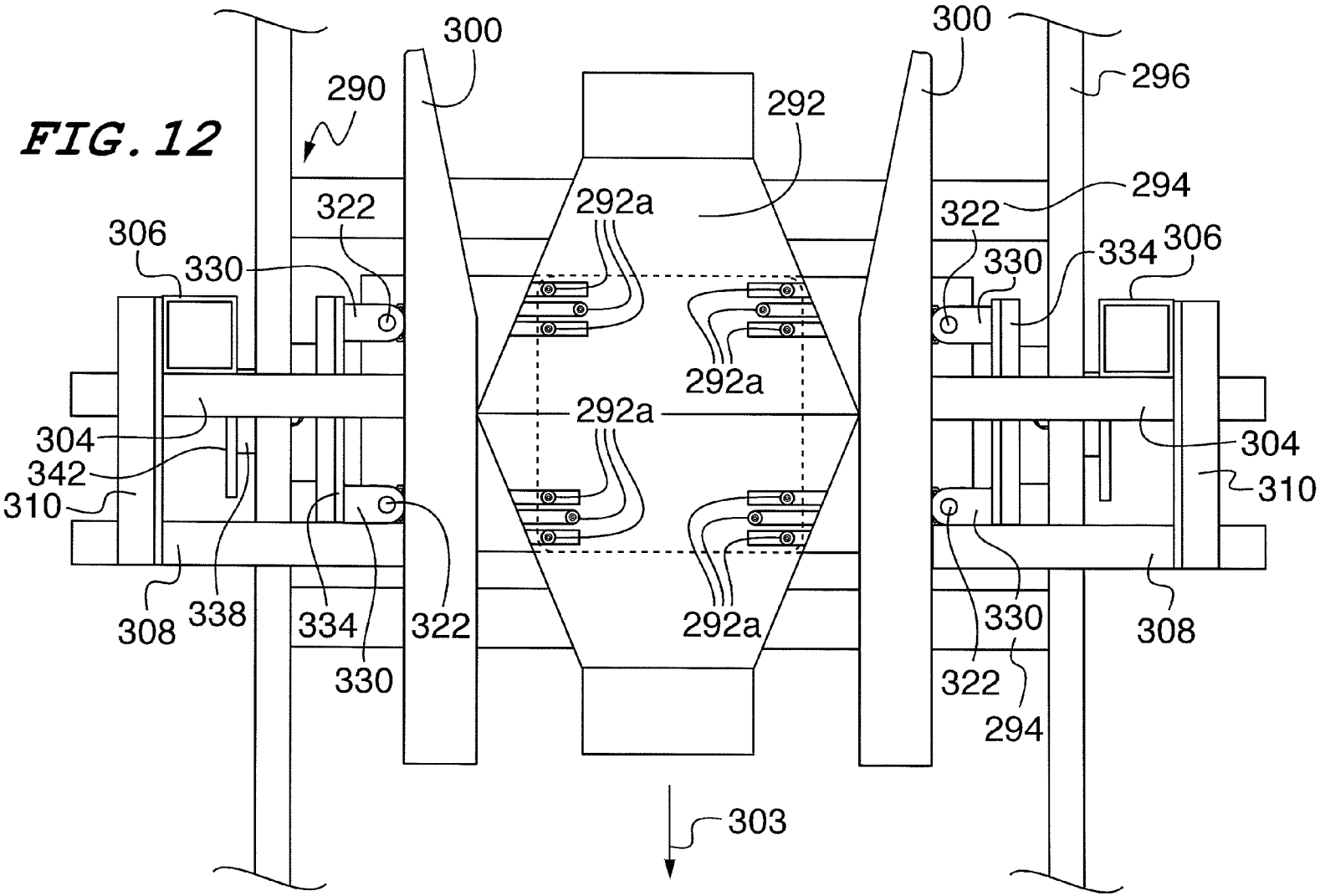
FIG. 12 is a top view of a portion of the concrete molding machine of the prior art illustrating a prior art wallstones being conveyed over the device of the present invention.
Figure 13:
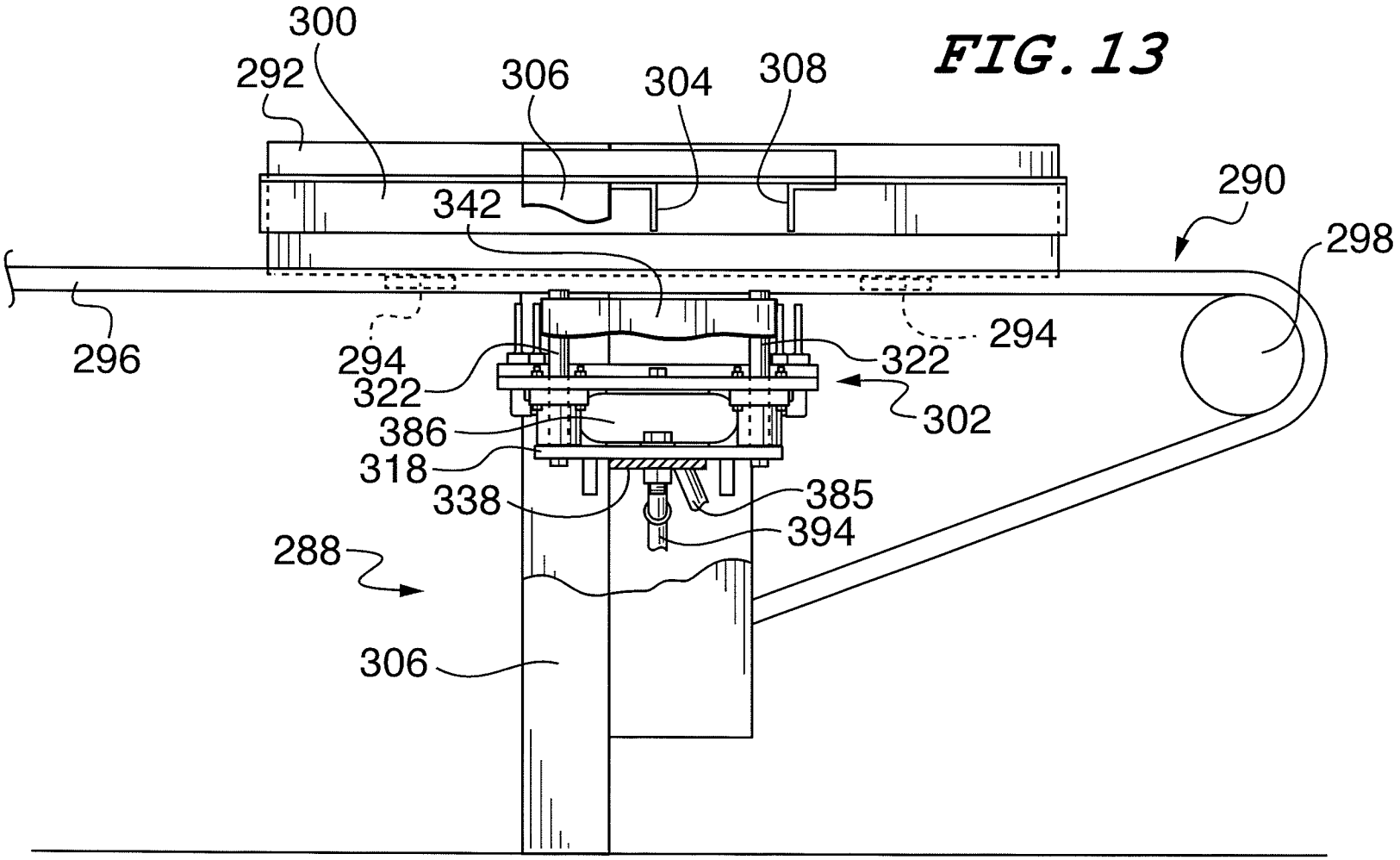
FIG. 13 is an elevational view of the device of the present invention shown, the device shown affixed to the framework of a prior art concrete molding machine.

Referring now to FIGS. 10, 12, and 13, the concrete block molding machine 30 includes a stationary support frame 288 for supporting a closed-loop conveyor system 290 (FIG. 13) adapted for transporting loads such as a finished block 292 to a predetermined location for flushing loose concrete particles from within the passages 292*a* therein. It should be understood that the prior art concrete block molding machine is capable of molding a variety of concrete blocks having different shapes and sizes, depending upon the mold being utilized. Therefore, it should be understood that the finished block shown at 292 is exemplary only and the debris cleaning device of the present invention could easily be adapted for use on other types of concrete blocks having different shapes and sizes and passages located differently without departing from the scope of the invention. As best shown in FIG. 10, the plurality of passages 292*a* extend vertically through the block 292, each passage likely containing debris needing to be flushed out.

Referring now to FIGS. 12 and 13, the conveyor system 290 includes a pair of parallel belts 296 which are spaced apart from each other by a predetermined distance. Each belt 296 is a continuous loop and could be of the link roller chain type. The conveyor system also includes powered pulleys 298 and idler pulleys (not shown) about which the belts 296 rotate. When energized, the powered pulleys 298 move the belts 296 and the materials on the belts, e.g., the finished block 292. As best shown in FIG. 12, a plurality of support slats 294 extend in a direction perpendicular to the belts 296 and attach to the belts to provide support for the finished block 292 as it is conveyed on the conveyor system 290. The support slats 294 are positioned to avoid contact with the passages 292*a* of the finished block 292.

A pair of opposed stationary guides 300 are provided for guiding and positioning the finished block 292 as it is conveyed in the direction of travel indicted by arrow 303 over the debris removal device 302 of the present invention. The guides 300 include a slightly tapered configuration at the inlet end to precisely align the finished block as it is conveyed over the debris removal device 302. Each opposed guide 300 is affixed, e.g., welded, to an angle-iron support beam 304, which in turn is affixed, e.g., welded, to a vertical support post 306, having a generally square cross-sectional shape, as best shown in FIG. 12. The vertical support posts are supported on the floor 305 of the facility in which the concrete block molding machine is located. Additional angle-iron beams 308 are affixed, e.g., welded, to each guide 300 to provide added support to the guide. The angle-iron beams 308 are affixed, e.g., welded, to connecting angle-iron beams 310, which in turn, are affixed, e.g., welded, to the vertical posts 306.

Referring now to FIGS. 10 and 10A, the debris removal device 302 of the present invention is shown supported by a stationary support frame 314 located under the conveyor system 290. The stationary support frame 314 includes a horizontal center plate 318 on which the debris removal device 302 is supported. A plurality of threaded shafts 322, e.g., four, extend vertically upwardly from the horizontal center plate 318 and are affixed to the center plate 318 by any suitable means, e.g., bolts 326 passing through openings (not shown) in the center plate 318 and into the internally threaded bottom end of the shafts 322. As best shown in FIGS. 10A and 12, the shafts 322 extends upwardly and through a circular opening in a corresponding collar 330, the collar 330 being affixed, e.g., welded, to an upstanding L-shaped support beam 334, the support beam 334 being affixed to the horizontal center plate 318 by any suitable means, e.g., welding. The horizontal center plate 318 is secured to the vertical support post 306 by any suitable means. As best shown in FIG. 10, the horizontal center plate 318 is affixed to an angle beam 338 using suitable hardware, e.g., nut, washer and hexagonal bolt. In turn, the angle beam 338 is affixed, e.g., welded, to a side plate 342, which is affixed to the vertical support post 306 by any suitable means, e.g., welding.

Figure 14:
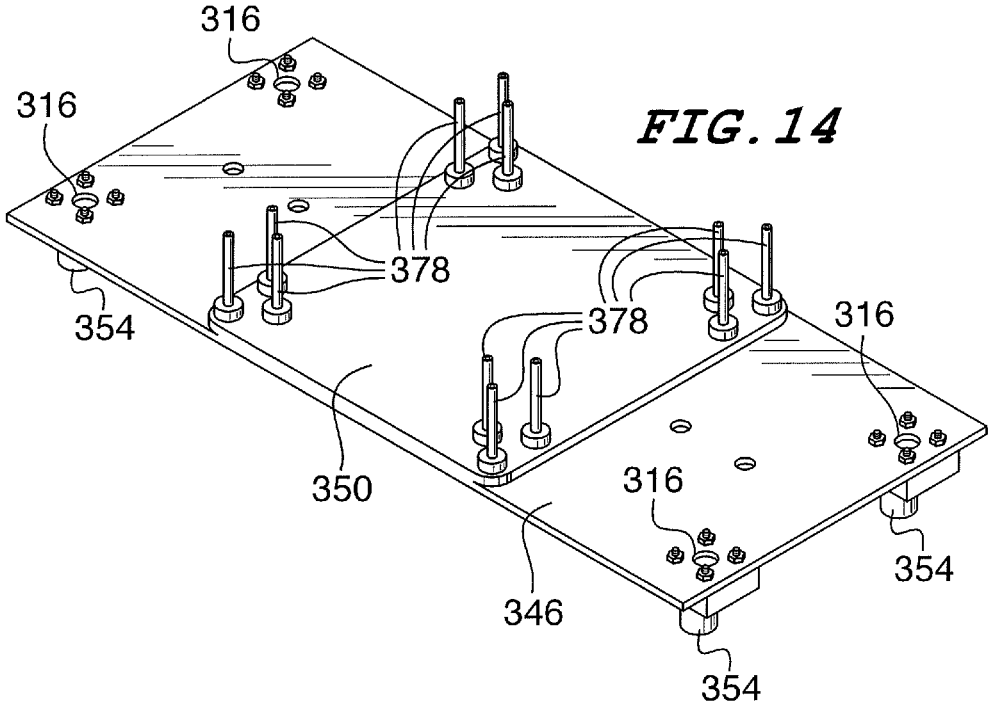
FIG. 14 is a perspective view showing the top of the device of the present invention; and, FIG. 15 is a perspective view showing the bottom of the of the device of the present invention.
Figure 15:
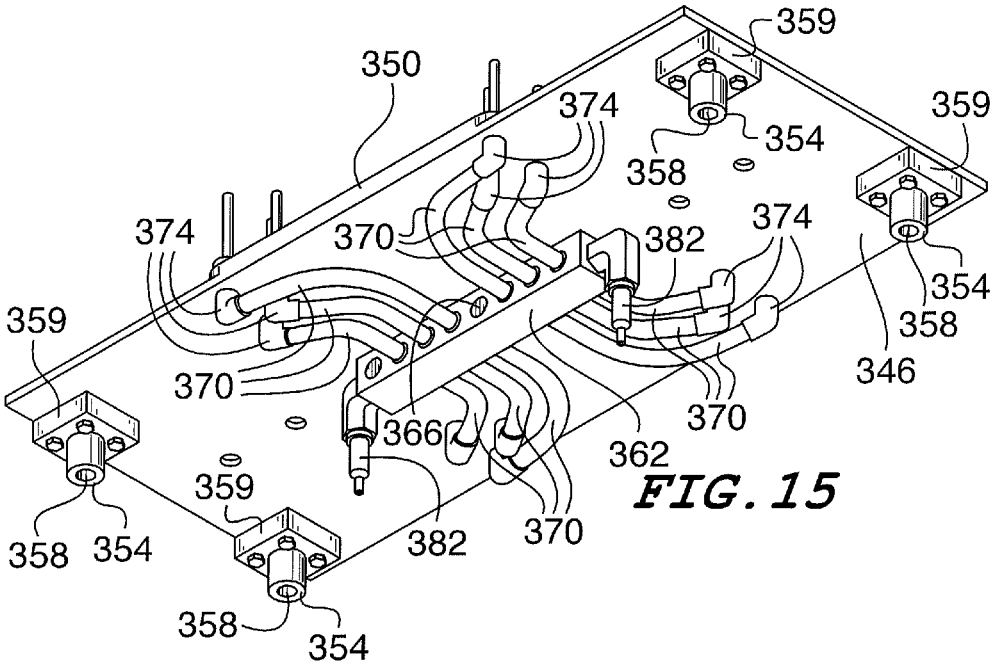

Referring now to FIGS. 14 and 15, the debris removal device 302 includes a rectangular plate assembly 346 having a thickened central portion 350, which is generally square in shape. The thickened central portion 350 may be an integral part of the plate assembly 346, or may fabricated separately and secured to the plate assembly 346 by any suitable means, e.g., mounting hardware. At each corner of the rectangular plate assembly 346 a set of mounting holes is provided. In this case, each set includes four mounting holes arranged in a square pattern. The mounting holes enable attachment of bushings 354 to the underside of the plate assembly 346. For example, as best shown in FIG. 10A, each bushing 354 includes an upper shoulder to enable securement of the bushing 354 to the underside of the plate assembly 346 by utilizing a square-shaped fitting 358 in which the bushing 312 is held captive. The fitting 358 is secured to the underside of the plate assembly 346 utilizing conventional hardware, e.g., nuts, bolts, and washers. Each bushing 354 is shown as being cylindrical in shape and including a central opening 359 that corresponds in size with an opening 316 located centrally within the mounting holes at the corners of the rectangular plate assembly 346.

Figure 11:
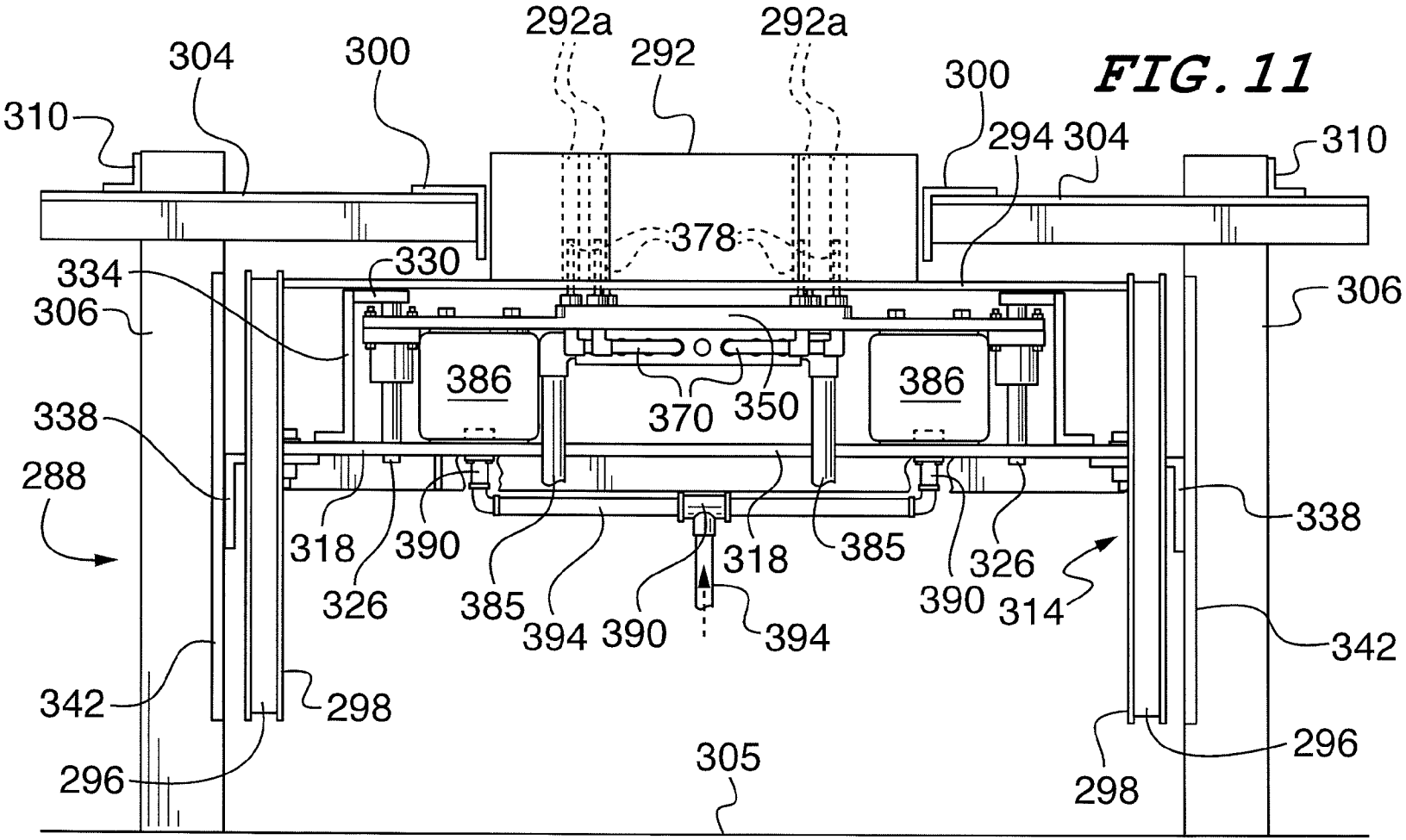
FIG. 11 is an elevational view of the device of the present invention illustrating the device in the extended position.

Referring to FIGS. 10, 10A and 11, the upwardly extending threaded shafts 322 of the horizontal plate 318 are shown extending through the central openings of the bushings 354 located in the corners of the horizontal plate 318. In this manner, the debris removal device 302 is mounted to the stationary support frame 314. Referring again to FIGS. 14 and 15, attached to the underside of the plate assembly 346 is an air manifold 362 having a plurality of ports 366, each port being sized and configured to receive an air hose 370. Each air hose 370 is connected to a coupling 374 which, in turn, is connected to an air nozzle 378 located on the top side of the plate 346. As best shown in FIG. 14, each air nozzle 378 is mounted to a through opening located in a corner of the square shaped thickened central portion 350 of the rectangular plate assembly 346. The air manifold 362 is connected to a system for delivering pressurized or compressed air (not shown) through two couplings 382 extending from the manifold 362. The couplings 382 are connected to system for delivering pressurized or compressed air (not shown) in known ways using conventional hoses 385 (FIG. 10)

FIGS. 10 and 11 illustrate operation of the debris removal device 302 of the present invention. As best shown in FIG. 10, several inflatable-deflatable air bellows 386 are situated between the horizontal plate 318 and the plate assembly 346 of the debris removal device 302. Each air bellows 386 has a top and bottom mounting surface and is generally cylindrical in shape. Each air bellows 386 is made of an expandable material, such as rubber, and upon inflation, each is arranged to provide a lifting force to raise the rectangular plate assembly 346 from a retracted position (FIG. 10) to an extended position (FIG. 11). Couplings 390 and hoses 394 may be utilized to connect the air bellows 386 to the system for delivering pressurized air (not shown) to enable inflation of the air bellows 386. In operation, the finished block 292 is conveyed over the debris removal device 302 in known ways using conventional hardware and software.

For example, as the support slat 294 continues to move with the conveyor belts 296, an encoder (not shown) may transmit pulses to a processor (not shown) at a predetermined time interval, the processor keeping count of the number of pulses received from the encoder. By knowing the speed of the conveyor belts 296 and knowing the count of pulses received from the encoder, the location of a slat 294 supporting a finished block 292 may be determined with a high degree of accuracy. In this manner, a predetermined count of pulses received by the processor, e.g., 1124 pulses, may be associated with a slat 294 supporting a finished block 292 reaching a predetermined position over the debris removal device 202, as best shown in FIG. 13. Upon reaching this predetermined position, a signal may be sent from the processor to de-energize the powered pulleys 298 to bring the finished block 292 to a stop at the predetermined position over the debris removal device 302. In addition, in advance of reaching the predetermined position, 50-100 pulses before reaching the predetermined count, a signal may be sent from the processor to decelerate the speed of the conveyor belts 296 to ensure more accurate positioning of the finished block 292 over the debris removal device 302.

Simultaneously, upon reaching the predetermined position, the processor may send a signal to energize a solenoid (not shown) to deliver pressurized air to inflate the air bellows 386 which lifts the rectangular plate assembly 346 upwardly from the retracted position to the extended position, whereupon the air nozzles 378 enter the passages 292*a* of the block 292. In FIG. 13, the air bellows 386 is shown in the inflated condition. Shortly thereafter, the system for delivering pressurized air is again actuated this time to deliver a short burst of pressurized air through the air nozzles 378 (FIGS. 11 and 12) to remove debris from within the passages 292*a* of the finished block 292. Thereafter, the solenoid is de-energized and the air bellows 386 is permitted to deflate, thus moving the rectangular plate assembly 346 from the extended position (FIGS. 11 and 13) to the retracted position and to remove the air nozzles 378 from within the passages to enable continued conveyance of the finished block 292. Upon return of the rectangular plate to the retracted position, a limit switch (not shown) may be moved from an open position to the closed position to reset the pulse counter to zero and re-energize the powered pulleys 298 to bring the next finished block 292 to the predetermined position over the debris removal device 302.

It is understood that the device for removing debris from passages of manufactured modular blocks of the present invention and its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

I claim:

1. A device for removing concrete debris from passages within modular blocks that have been formed by a block molding machine, the block molding machine including a mold, a conveyor for transporting modular blocks after molding, and a framework, each modular block including a top, a bottom, a front face, a back face, a first side, and a second side, the passages extending the entire height of the block from the top to the bottom, said device for removing debris comprising:

a. a plate having mounting holes defined therein and corresponding with the location of the passages on the modular blocks;

b. an actuator secured to the framework of the block molding machine and supporting said plate, said actuator operative to move said plate from a retracted position to an extended position in close proximity to the conveyor;

c. nozzles mounted within the mounting holes of said plate and operatively connected to a source of compressed air, said nozzles arranged to enter within the passages of the modular block upon movement of said plate to said extended position; and, d. a control system to direct operation of said device for removing debris, such that upon a modular block reaching a predetermined location on the conveyor, said control system energizes said actuator to move said mounting plate to said extended position causing said nozzles to enter within the passages of the modular block and emit jets of compressed air to remove concrete debris from within the passages.

2. The device for removing debris of claim 1, wherein said actuator is secured to the framework beneath the conveyor.

3. The device for removing debris of claim 1, wherein said actuator is a bellows chamber operatively connected to a source of compressed air.

4. The device for removing debris of claim 1, wherein the passages of the block are arranged in a predetermined configuration, and wherein said nozzles are mounted within said mounting holes of said plate at locations matching the predetermined configuration.

5. The device for removing debris of claim 1, wherein the manufactured modular block includes passages located within offset pockets located in the top of the manufactured modular block, and wherein said mounting holes correspond with the locations of the passages within the offset pockets.

6. The device for removing debris of claim 5, wherein the manufactured modular block includes a pair of grooves located on either side of the offset pockets, the pair of grooves extending across a portion of the top of the block and wherein a passage is located within each groove, and wherein said mounting holes correspond with the location of the passages within each groove.

* * * * *